United States Patent [19]

Borst et al.

[11] 4,355,985

[45] Oct. 26, 1982

[54] MARINE PROPULSION DEVICE WITH SELF-CENTERING STEERING MECHANISM

[75] Inventors: Gaylord M. Borst; Frank J. Walsworth, both of Waukegan, Ill.

[73] Assignee: Outboard Marine Corporation, Waukegan, Ill.

[21] Appl. No.: 213,996

[22] Filed: Dec. 8, 1980

[51] Int. Cl.[3] ..... B63H 25/42

[52] U.S. Cl. ..... 440/51; 440/63

[58] Field of Search ..... 440/51, 53, 55, 56, 440/57, 58, 59, 60, 61, 62, 63, 64, 65, 66, 900; 114/163, 164, 144 R; 244/87, 90 B

[56] References Cited

U.S. PATENT DOCUMENTS

| | | | |
|---|---|---|---|
| 2,723,639 | 11/1955 | Hinrichs et al. | 440/55 |
| 2,993,464 | 7/1961 | Conover | 440/51 |
| 3,943,878 | 3/1976 | Kirkwood | 440/51 |

*Primary Examiner*—Trygve M. Blix
*Assistant Examiner*—Jesús D. Sotelo
*Attorney, Agent, or Firm*—Michael, Best & Friedrich

[57] ABSTRACT

Disclosed herein is a marine propulsion device comprising a lower unit, a swivel bracket on the lower unit adapted for connecting the lower unit to the transom of a boat for steering movement about a steering axis, a steering control on the lower unit adapted for steerably displacing the lower unit about the steering axis relative to a fore and aft position, a trim tab mounted on the lower unit rearwardly of the steering axis for pivotal movement relative to a position aligned fore and aft with the lower unit, and a linkage connected to the trim tab and responsive to pivotal steering displacement of the lower unit for pivotally displacing the trim tab relative to the lower unit in the same pivotal direction as steering displacement of the lower unit.

7 Claims, 3 Drawing Figures

Fig. 1
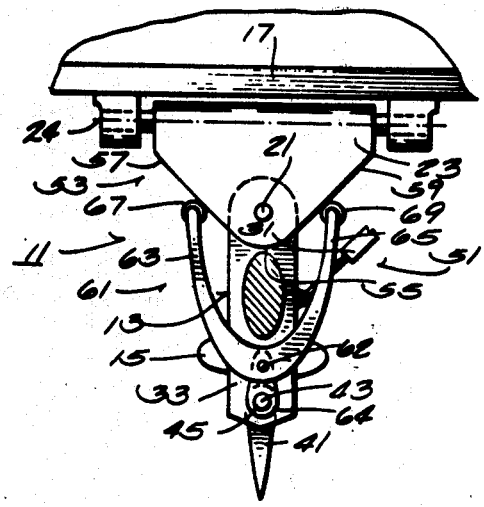
Fig. 2
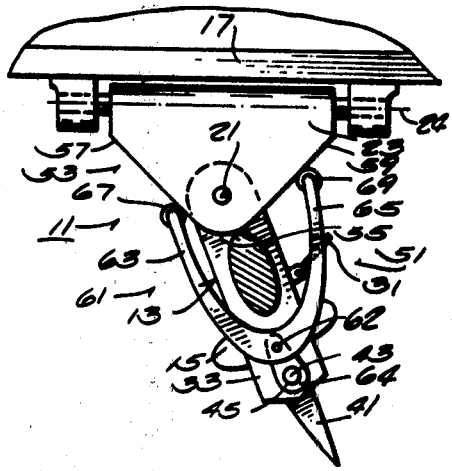
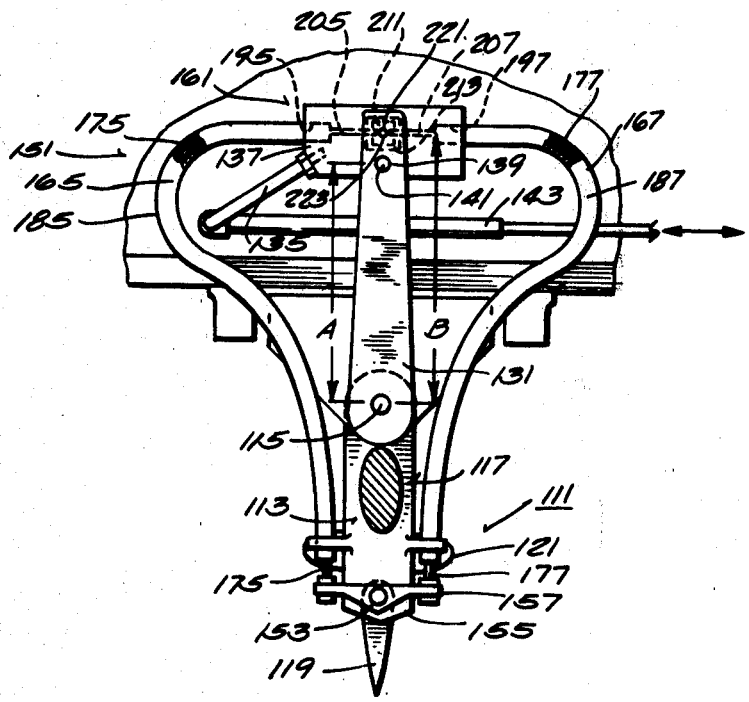
Fig. 3.

MARINE PROPULSION DEVICE WITH SELF-CENTERING STEERING MECHANISM

BACKGROUND OF THE INVENTION

The invention relates generally to marine propulsion devices, such as outboard motors and stern drive units, which devices have lower units with adjustable trim tabs. More particularly, the invention also relates to adjustably mounted trim tabs and to arrangements for affecting adjustment in the position of such trim tabs.

Attention is directed to the U.S. Hinrichs Pat. No. 2,723,639 issued Nov. 15, 1955 and to the U.S. Daniels Pat. No. 2,726,622 issued Dec. 13, 1955.

Attention is also directed to the U.S. Conover Pat. No. 2,993,464 issued July 25, 1961 and to the U.S. Kirkwood Pat. No. 3,943,878 issued Mar. 16, 1976. Attention is further directed to the U.S. Broadwell Pat. No. 3,149,605 issued Sept. 22, 1964.

SUMMARY OF THE INVENTION

The invention provides a marine propulsion device comprising a lower unit, means on the lower unit adapted for connecting the lower unit to the transom of a boat for steering movement about a steering axis, means on the lower unit adapted for steerably displacing the lower unit about the steering axis relative to a fore and aft position, a trim tab, means mounting the trim tab on the lower unit rearwardly of the steering axis for pivotal movement relative to a position aligned fore and aft with the lower unit, and means connected to the trim tab and responsive to pivotal steering displacement of the lower unit for pivotally displacing the trim tab relative to the lower unit in the same pivotal direction as steering displacement of the lower unit.

In one embodiment of the invention, the means for connecting the lower unit to the boat transom includes a swivel bracket adapted to be fixed to the boat transom, and the lower unit is pivotally connected to the swivel bracket about the steering axis, and the trim tab displacement means comprises cam means on one of the swivel bracket and the trim tab and follower means on the other of the swivel bracket and the trim tab and connected to the cam means.

In one embodiment of the invention, the cam means is located on the swivel bracket and comprises an arcuate section extending to each side of the fore and aft direction, and having a common radius about the steering axis, and respective end portions extending from the opposite ends of the arcuate section in tangential relation thereto and at ever increasing distances from the steering axis, and the follower means comprises a link connected fixedly to the trim tab and including spaced followers engaged with the cam surface.

In one embodiment of the invention, the lower unit includes a forwardly extending steering arm connected at a first distance from the steering axis to the means for steerably displacing the lower unit about the steering axis, and the means for displacing the trim tab comprises a linkage connected to the trim tab and to the steering arm at a second distance from the steering axis greater than the first distance.

In one embodiment of the invention, the linkage comprises an anchor connected to the steering arm, a pair of push-pull cables respectively connected, at one end, to the anchor and respectively connected, at the other end, to the trim tab at points on opposite sides of the axis of trim tab pivotal movement.

In one embodiment of the invention, the trim tab has connected thereto for common pivotal movement a cross bar having opposite ends, and the cables are respectively connected to the opposite ends.

In one embodiment of the invention, the push-pull cables respectively extend on opposite sides of the lower unit.

Other features and advantages of the embodiments of the invention will become known by reference to the following general description, claims, and appended drawings.

IN THE DRAWINGS

FIG. 1 is a schematic view of a marine propulsion device incorporating various of the features of the invention and illustrating the lower unit located in a fore and aft position.

FIG. 2 is a view similar to FIG. 1 illustrating the components when the lower unit is displaced from a fore and aft position.

FIG. 3 is a schematic plan view of a modified marine propulsion device incorporating various of the features of the invention.

Before explaining two embodiments of the invention in detail, it is to be understood that the invention is not limited in its application to the details of construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

GENERAL DESCRIPTION

Shown schematically in FIG. 1 is a marine propulsion device 11, such as an outboard motor or a stern drive unit, comprising a lower unit 13 which rotatably supports a propulsion element, such as a propeller 15, and which is supported from a boat transom 17 for pivotal steering movement about a steering axis 21 and relative to a fore and aft position illustrated in FIG. 1 by any suitable means. In the illustrated construction, such means comprises a swivel bracket 23 which can be connected to the boat transom 17 by any suitable means which prevents steering movement relative to the boat transom 17 and which can provide for tilting movement about a horizontal axis 24 relative to the boat transom. The swivel bracket 23 is connected by any suitable means to the lower unit 13 for lower unit steering movement about the steering axis 21.

The marine propulsion device 11 also includes means 31 connected to the lower unit 13 and adapted for pivotally or steerably displacing the lower unit 13 about the steering axis 21 and relative to the fore and aft position. Any suitable means well known in the art can be employed.

Carried by the lower unit 13, preferably below a cavitation plate 33 provided on the lower unit 13, and rearwardly of the propeller 15 is a trim tab 41 which is mounted for pivotal movement about an axis 43 generally parallel to the steering axis 21 and relative to a centered position aligned in the fore and aft direction with the lower unit 13 and shown in FIG. 1.

Various trim tab mounting arrangements can be employed and, in the illustrated construction, the trim tab 41 includes a vertical post 45 which extends through a bearing in the cavitation plate 33.

The marine propulsion device 11 also includes means 51 connected to the trim tab 41 and responsive to pivotal steering movement of the lower unit 13 from the fore and aft or centered position for pivotally displacing the trim tab 41 relative to the lower unit 13 from the centered or fore and aft position in the same pivotal direction as steering displacement of the lower unit 13. While various constructions can be employed, in the illustrated construction, such means comprises cam means on one of the trim tab 41 and swivel bracket 23 and follower means on the other of the trim tab 41 and swivel bracket 23 and operably engaged or connected with the cam means. In the specific construction illustrated, the cam means is provided on the swivel bracket 23 and comprises a cam surface 53 including an arcuate section 55 extending at a uniform radius from the steering axis 21 for about 45° to both sides of a fore and aft line through the steering axis 21. The cam surface 53 also includes respective end sections 57 and 59 which extend tangentially and rectilinearly forwardly from the opposite ends of the arcuate section 55 at an included angle of about 90° and thus at an ever increasing distance from the steering axis.

In the specifically illustrated construction, the follower means comprises a schematically illustrated rigid link 61 which is pivotally connected at 62 to a lever 64 extending fixedly from the trim tab 41, as for instance, to the trim tab mounting post 45, and which includes two angularly related legs 63 and 65, the legs 63 and 65 having, at the forward end thereof, respective followers which can be in the form of respective rollers 67 and 69. The rollers 67 and 69 are spaced apart and engage the cam surface 53 at spaced points. When the lower unit 13 is located in the fore and aft position, the followers 67 and 69 respectively engage the end sections 57 and 59 of the cam surface 53 at approximately the same relative locations thereon.

When the lower unit 13 is pivotally displaced from the fore and aft position, the rigid link 61 is also displaced along the cam surface 53. Such displacement causes angular shifting of the link 61 relative to the swivel bracket 23 and simultaneously causes pivotal movement of the trim tab 41 about the axis 43 relative to the lower unit 13 in the same pivotal direction as movement of the lower unit relative to the swivel bracket 23 about the steering axis 21.

Upon return steering displacement of the lower unit 13 to the fore and aft position, the rigid link 61 will be caused to shift in the opposite angular direction so as to cause return pivotal movement of the trim tab 41 about the axis 43 relative to the lower unit 13 to the position aligned fore and aft with the lower unit.

Accordingly, in the event that steering control is lost for one reason or another, the trim tab 41 will serve to cause displacement of the lower unit 13 to the fore and aft position. Such displacement of the lower unit 13 to the fore and aft position also causes displacement of the trim tab 41 to the position aligned in the fore and aft direction with the lower unit 13. When thus positioned, the trim tab 41 will no longer cause steering movement of the lower unit 13. Thus, the lower unit 13 will return to and/or remain in a fore and aft position in the absence of steering control by an operator.

Shown schematically in FIG. 3 is another embodiment of a marine propulsion device incorporating various of the features of the invention. More particularly, the marine propulsion device is in the form of an outboard motor 111 including a propulsion unit 113 which is steerable about an axis 115 and which includes a lower unit 117 provided with an adjustably mounted trim tab 119 located rearwardly of a rotatably mounted propelling element, such as a propeller 121. Any suitable means can be employed for supporting the propulsion unit 113 from a boat transom, such as, for instance, a conventional transom bracket and a conventional swivel bracket which is tiltably connected to the transom bracket about a horizontal axis and which supports the propulsion unit 113 for steering about the axis 115 which is transverse to the horizontal tilt axis.

The propulsion unit 113 conventionally includes a steering arm 131 which extends fixedly from the propulsion unit 113 and forwardly from the steering axis 115.

In order to pivotally displace the propulsion unit 113 for steering displacement about the steering axis 115, any suitable steering mechanism can be provided. In the illustrated construction, such means comprises a drag link 135 which, at one end, is fixed, for common movement, to a control block 137 which, in turn, is pivotally connected to the steering arm 131 by a pin 139 providing an axis 141 at a first distance "A" from the steering axis 115. At its other end, the drag link 135 is pivotally or otherwise connected to any suitable steering control actuator or linkage 143 for transversely displacing the other end of the drag link 135 so as to pivot the steering arm 131 and cause steering movement of the propulsion unit 113 about the steering axis 115.

As in the embodiment disclosed in FIGS. 1 and 2, there is also provided means 151 responsive to pivotal steering displacement of the lower unit 113 for pivotally displacing the trim tab 119 relative to the lower unit in the same pivotal direction as steering displacement of the lower unit 113. More specifically in this regard and as already indicated, the trim tab 119 includes a post 153 which extends upwardly through a bearing in a cavitation plate 155 and which, at its upper end, is fixedly connected to a cross bar 157 having opposite ends.

While various constructions can be employed, in the illustrated construction, the trim tab displacement means 151 comprises a linkage 161 connected to the trim tab 119 and to the steering arm 131. Still more particularly, in the illustrated construction, the linkage 161 comprises a pair of flexible push-pull cables 165 and 167 which include respective inner cores 175 and 177 and an outer sheaths 185 and 187. At their rearward ends, the inner cores 175 and 177 are respectively fixedly connected to the opposite ends of the trim tab cross bar 157, and the outer sheaths 185 and 187 are respectively fixedly connected to opposite sides of the cavitation plate 155 or to any other convenient structure. The push-pull cables 165 and 167 extend forwardly along the opposite sides of the lower unit 117 and, at their forward ends, the outer sheaths 185 and 187 are fixedly connected in respective sockets 195 and 197 provided in the control block 137 and the inner cores 175 and 177 extend from the outer sheaths 185 and 187 through passages 205 and 207 extending from the sockets 195 and 197 and are fixedly connected to an anchor or coupling 211 which is located within an enlarged chamber 213 in the control block 137. The coupling 211 is pivotally connected to the steering arm 131 by a pin 221 providing an axis 223 located at a distance "B" from the steering axis 115 greater than the distance "A" from the steering axis 115 to the axis 141 of the pivotal connection of the control block 137 with the steering arm 131.

The chamber 213 in which the coupling 211 is located is dimensioned so as to provide, in response to drag link movement which is effective to pivot the steering arm 131, an initial limited amount of pivotal movement of the block 137 relative to the steering arm 131, which pivotal movement generates relative movement of the inner cores 175 and 177 within the outer sheaths 185 and 187. Such relative movement of the inner cores 175 and 177 relative to the outer sheaths 185 and 187 is effective to cause pivotal displacement of the trim tab 119 in the same direction as lower unit movement occurring in response to drag link movement.

In the event of loss of attention to steering by the operator during turning movements, the resulting angular orientation of the trim tab 119 relative to the lower unit 117 will cause return movement of the propulsion unit 113 to the fore and aft position. Such propulsion unit steering movement will cause, upon return to the fore and aft position of the lower unit 117, return of the trim tab 119 to a centered position in alignment with fore and aft disposition of the lower unit 117. Propulsion thereafter will be straight ahead in the absence of attention by the operator to steering.

Various of the features of the invention are set forth in the following claims.

We claim:

1. A marine propulsion device comprising a lower unit, means on said lower unit adapted for connecting said lower unit to the transom of a boat for steering movement about a steering axis, means on said lower unit adapted for steerably displacing said lower unit about the steering axis relative to a fore and aft position, a trim tab, means mounting said trim tab on said lower unit rearwardly of the steering axis for pivotal movement relative to a position aligned fore and aft with said lower unit, and means connected to said trim tab and responsive to pivotal steering displacement of said lower unit for pivotally displacing said trim tab relative to said lower unit in the same pivotal direction as steering displacement of said lower unit.

2. A marine propulsion device in accordance with claim 1 wherein said means for connecting said lower unit to the boat transom includes a swivel bracket adapted to be fixed to the boat transom, and wherein said lower unit is pivotally connected to said swivel bracket about the steering axis, and wherein said trim tab displacement means comprises cam means on one of said swivel bracket and said trim tab and follower means on the other of said swivel bracket and said trim tab and connected to said cam means.

3. A marine propulsion device in accordance with claim 2 wherein said cam means is located on said swivel bracket and comprises an arcuate section extending to each side of the fore and aft direction, having a common radius about the steering axis, and having opposite ends, and respective end portions extending from said opposite ends of said arcuate section in tangential relation thereto and at ever increasing distances from the steering axis, and wherein said follower means comprises a link connected fixedly to said trim tab and including spaced followers engaged with said cam surface.

4. A marine propulsion device in accordance with claim 1 wherein said lower unit includes a forwardly extending steering arm connected at a first distance from the steering axis to said means for steerably displacing said lower unit about the steering axis, and wherein said means for displacing said trim tab comprises a linkage connected to said trim tab and to said steering arm at a second distance from the steering axis greater than said first distance.

5. A marine propulsion device in accordance with claim 4 wherein said linkage comprises an anchor connected to said steering arm, a pair of push-pull cables respectively connected, at one end, to said anchor and respectively connected, at the other end, to said trim tab at points on opposite sides of the axis of trim tab pivotal movement.

6. A marine propulsion device in accordance with claim 5 wherein said trim tab has connected thereto for common pivotal movement a cross bar having opposite ends, and wherein said cables are respectively connected to said opposite ends.

7. A marine propulsion device in accordance with claim 6 wherein said push-pull cables respectively extend on opposite sides of said lower unit.

* * * * *